US006053103A

United States Patent [19]

Wadlinger

[11] Patent Number: 6,053,103

[45] Date of Patent: Apr. 25, 2000

[54] SHEET-FED PRINTING PRESS HAVING AT LEAST ONE SHEET GUIDE DRUM

[75] Inventor: Ralf Wadlinger, Ludwigshafen, Germany

[73] Assignee: Heidelberger Druckmaschinen Aktiengesellschaft, Heidelberg, Germany

[21] Appl. No.: 09/275,378

[22] Filed: Mar. 24, 1999

[30] Foreign Application Priority Data

Mar. 24, 1998 [DE] Germany ..... 198 12 769

[51] Int. Cl.[7] ..... B41F 21/10; B41F 13/08; B65H 5/06

[52] U.S. Cl. ..... 101/407.1; 101/419; 101/479; 101/232; 492/48; 492/60; 271/277

[58] Field of Search ..... 101/231, 232, 101/246, 407.1, 408, 419, 420, 479; 271/7, 209, 211, 226, 234, 275, 277; 492/48, 60

[56] References Cited

U.S. PATENT DOCUMENTS

| | | | |
|---|---|---|---|
| 973,380 | 10/1910 | Parker . | |
| 1,324,738 | 12/1919 | Goedike . | |
| 3,537,632 | 11/1970 | Watson | 226/191 |
| 3,765,329 | 10/1973 | Kirkpatrick et al. | 101/415.1 |
| 3,978,974 | 9/1976 | Morissey et al. | 198/782 |
| 3,982,312 | 9/1976 | Finzer | 29/130 |
| 4,110,882 | 9/1978 | Hodge et al. | 29/118 |
| 4,241,518 | 12/1980 | Alexy | 34/110 |
| 4,846,062 | 7/1989 | Difflipp et al. . | |
| 4,973,040 | 11/1990 | Kemp et al. | 271/277 |
| 5,681,251 | 10/1997 | Shew | 492/46 |

FOREIGN PATENT DOCUMENTS

| | | |
|---|---|---|
| 1 251 343 | 10/1967 | Germany . |
| 86 11 832 | 12/1988 | Germany . |
| 293 989 A5 | 1/1990 | Germany . |
| 196 44 011 A1 | 5/1998 | Germany . |

*Primary Examiner*—Kimberly Asher
*Attorney, Agent, or Firm*—Herbert L. Lerner; Laurence A. Greenberg; Werner H. Stemer

[57] ABSTRACT

For changing demands in terms of the support of printed sheets as they are deflected in a sheet-fed printing press, the sheet-fed printing press is equipped with a retrofittable sheet guide drum. The drum includes segments on its face end and which in a first setup state has skeleton-shaped sheet supports separably connected to the segments and in a second setup state has a flexible drum jacket separably connected to the segments.

5 Claims, 10 Drawing Sheets

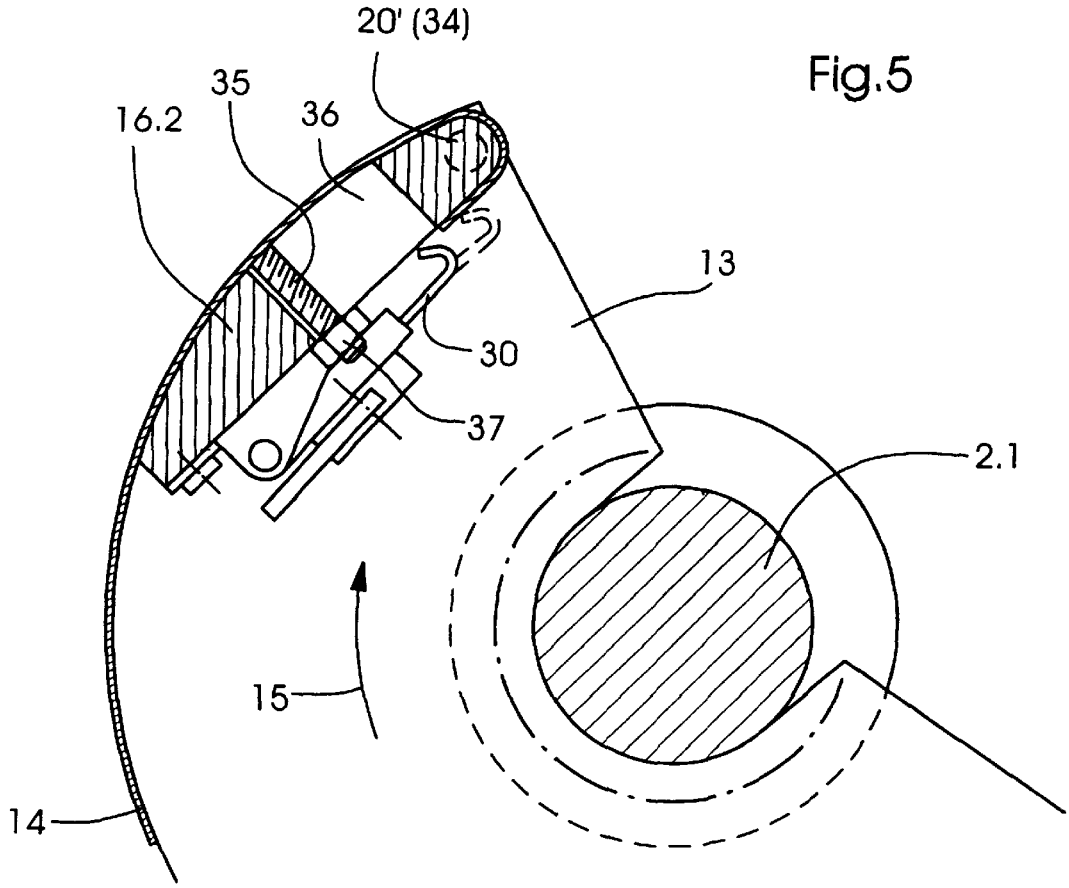
Fig.5
Fig.5a
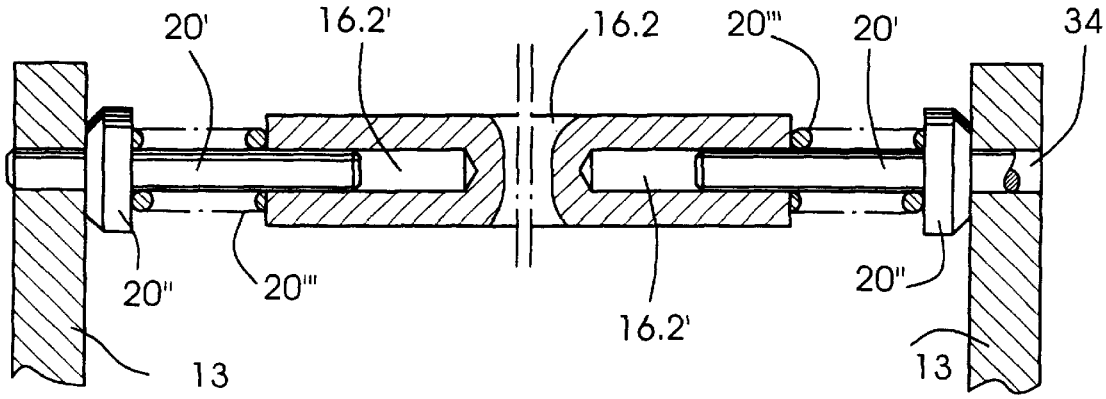

SHEET-FED PRINTING PRESS HAVING AT LEAST ONE SHEET GUIDE DRUM

BACKGROUND OF THE INVENTION

Field of the Invention

In sheet-fed printing presses, depending on its configuration, a sheet leaving a processing station must be supported at a variable number of points on its concave side during a deflection of the sheets that is done with corresponding compulsory guidance of the leading edge of the sheets in the processing direction. The concave side is often a freshly printed side of the sheets, so that the support must be accomplished without smearing. To that end, depending on the conditions of a printing job, sheet guide drums are used, which by skeleton-like sheet supports, such as a rowel assembly, have only an imaginary drum jacket face in the form of an envelope surface enclosing the sheet supports, or sheet guide drums that have a real drum jacket face. If the proper type of sheet guide drums, of the different types discussed thus far, are to be used, it may be necessary, along with the change from one printing job to the next, also to replace the sheet guide drums of one type with another. However, this often entails considerable assembly work, quite aside from the fact that the real drum jacket face, made as a cast part, for instance, can have a considerable weight. The assembly work may not be limited to merely replacing the sheet guide drum. To enable the installation and removal of the sheet guide drum, many parts of the printing press located around it, such as blowers, powder applicators or others, first have to be removed and then once the suitable sheet guide drum has been installed they have to be reinstalled as well. This leads to relatively long down times of the printing press upon a change of printing job and thus represents a cost factor that is deleterious to the economy of the printing press.

SUMMARY OF THE INVENTION

It is accordingly an object of the invention to provide a sheet-fed printing press having at least one sheet guide drum that overcomes the above-mentioned disadvantages of the prior art devices of this general type, in which the economy of a sheet-fed printing press having at least one sheet guide drum is improved so that when varying demands are made of the sheet guide drum, the down times of the printing press are shortened.

With the foregoing and other objects in view there is provided, in accordance with the invention, a sheet-fed printing press, including: at least one retrofittable sheet guide drum having an end face and segments disposed on the face end; and skeleton-shaped sheet supports separably connected to the segments in a first setup state; and a flexible drum jacket separably connected to the segments in a second setup state in place of the skeleton-shaped sheet supports.

To attain this object, the sheet-fed printing press is equipped with at least one sheet guide drum that is retrofittable and includes segments on its face end. In a first setup state, the drum has skeleton-like sheet supports separably connected to the segments and in a second setup state has a flexible drum jacket separably connected to the segments.

In printing presses equipped in this way, the sheet guide drums can be retrofitted in situ to adapt them to changing demands with regard to the support of printed sheets. Thus dismantling and reassembly of machine parts in the area of the sheet guide drums become unnecessary, and so the down time of the printing press between printing jobs that make different demands for supporting the aforementioned concave sides of the sheets printed on those sides are shortened. Advantageously, this also dispenses with the manipulation of relatively heavy machine parts, such as a sheet-guide drum made as a cast part for supporting the sheets over their full surface.

The advantage that retrofitting is possible in situ of a drum jacket on the sheet supports made of a skeleton framework and vice versa can also be utilized in printing presses which were initially configured for the replacement of a sheet guide drum of one of these types by one of another type. Because the replaceability makes it possible to install a sheet guide drum that is retrofittable according to the invention as long as the sheet guide drum has the same geometry, in the region of the bearing, as the interchangeable sheet guide drums provided in the initial setup of the printing presses.

Other features which are considered as characteristic for the invention are set forth in the appended claims.

Although the invention is illustrated and described herein as embodied in a sheet-fed printing press having at least one sheet guide drum, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 4–7 are sectional views of further exemplary embodiments for separable fixation of a leading end of a flexible drum jacket to face-end segments of the sheet guide drum;

DESCRIPTION OF THE PREFERRED EMBODIMENTS

Figure 1:
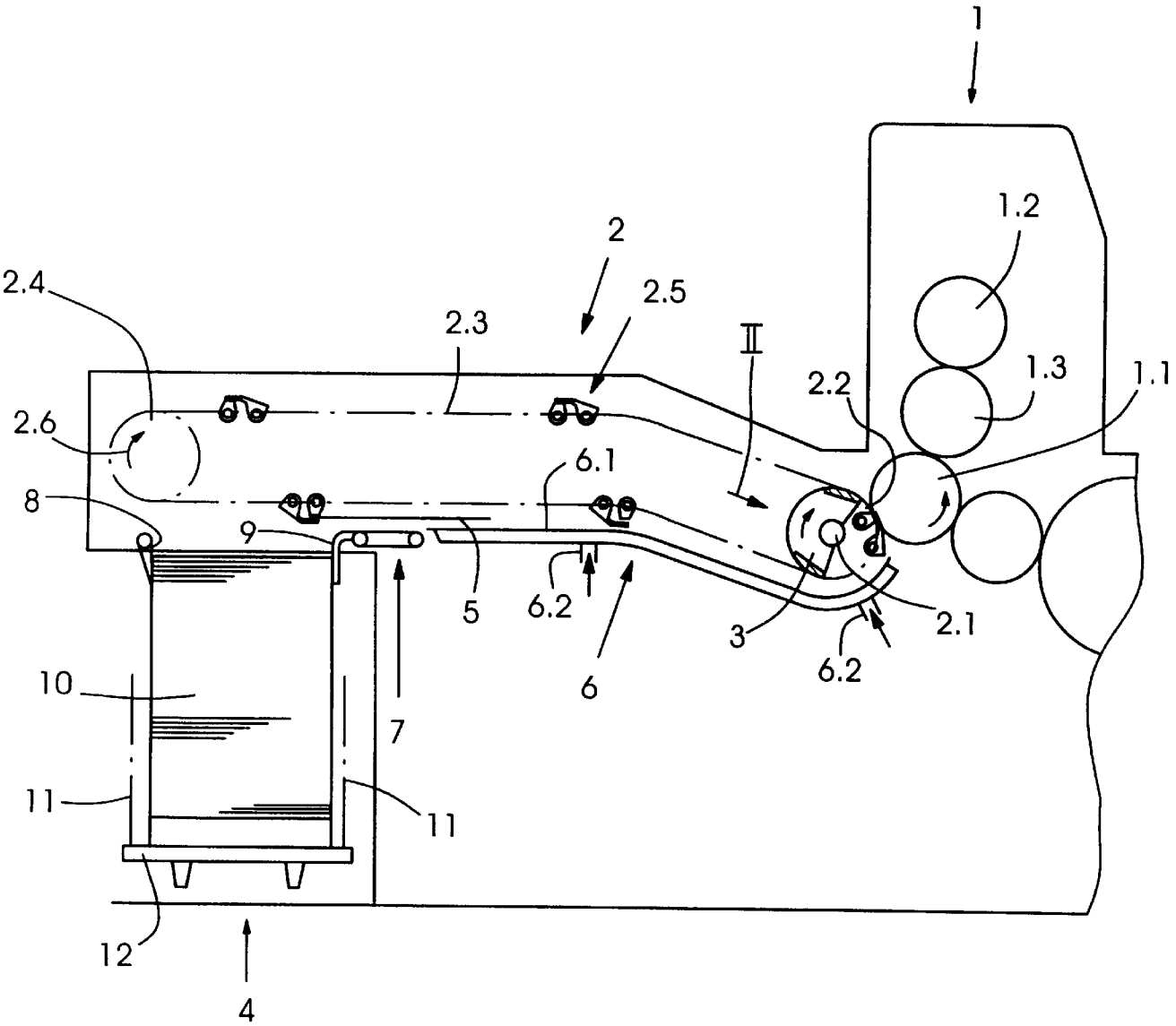
FIG. 1 is a diagrammatic, partial, side-elevational view of a portion of a sheet-fed printing press including a delivery system, with an exemplary embodiment of a sheet guide drum which rotates in operation and which supports sheets, taken from a print cylinder by a revolving gripper system and then delivered, after being turned over after the transfer, to a stacking station in a region where the turnover is done, by a drum jacket separably fixed to segments of the sheet guide drum.

In all the figures of the drawing, sub-features and integral parts that correspond to one another bear the same reference symbol in each case. Referring now to the figures of the drawing in detail and first, particularly, to FIG. 1 thereof, there is shown a sheet-fed printing press having a plurality of successive processing stations in the form of printing units, and with post-treatment stations, such as drying, coating and perforating stations. The printing press has a chain delivery system 2 following a final processing station 1. A sheet-guiding cylinder 1.1 of the final processing station 1 is assigned a sheet guide drum 3 that follows the A-2234 cylinder 1.1. The drum 3 is rotatable in operation with regard to a geometric pivot axis of a chain wheel shaft 2.1 in synchronism with a pair of chain wheels 2.2 that are rotatable relative to the geometric axis. On each of the chain wheels 2.2, between which the sheet-guide drum 3 extends, is disposed on a given side of the printing press an endless conveyor chain 2.3 that wraps around it. The conveyor chains 2.3 are also guided around a pair of deflection wheels 2.4 disposed in a region of a stacking station 4. The conveyor chains 2.3 carry gripper systems 2.5, which in operation accept a given sheet 5 from the sheet-guiding cylinder 1.1. To that end, each of the gripper systems 2.5 grasps a gripper edge, which is leading in the processing direction, of the given sheet 5 fastened by the gripper edge in the gripper of the sheet-guiding cylinder 1.1, and the grippers of the sheet-guiding cylinder 1.1 then open. The gripper edge is then followed by a gripper path, defined by a revolution of the conveyor chain 2.3 in the direction of revolution indicated by a directional arrow 2.6, so that the sheet 5, necessarily guided by its gripper edge, is turned around by deflection around the chain wheel shaft 2.1 after leaving the sheet-guiding cylinder 1.1.

In the present example shown in FIG. 1, the sheet-guiding cylinder 1.1 is the impression cylinder of a printing unit operating by the offset method with a rubber blanket on a rubber blanket cylinder 1.3 that is inked by a plate cylinder 1.2. The printing unit prints the sheet 5, guided by the impression cylinder, on the side of the sheet that is concave in the aforementioned ensuing deflection and is supported by the sheet-guide drum 3. After that, the gripper system 2.5 that keeps the sheet 5 fastened by its gripper edge transports the sheet 5 along the lower runs, in terms of FIG. 1, of the conveyor chains 2.3 via a sheet guide device 6. This device is typically equipped for creating a supporting air cushion between the sheet 5 and a sheet guide face 6.1 and to that end is provided with a non-illustrated nozzle assembly, in the sheet guide face 6.1 with the nozzles communicating with a supply system represented by the stubs 6.2. After the passage through the sheet guide device 6, the gripper systems 2.5 transfer the respective sheet 5 to a sheet brake 7. The sheet brake 7 slows down the sheets 5 to a deposition speed and finally releases them, so that a given sheet 5 while simultaneously moving downward strikes front-edge stops 8 with its leading edge and is aligned on them and on rear edge stops 9 facing them so that together with sheets 5 preceding and/or following it, it forms a stack 10. The stack 10 can be lowered by a lifting device to the extent to which the stack 10 grows. The lifting device is shown in FIG. 1 in the form of lifting chains 11 shown in dot-dashed lines and a platform 12 carried by the chains and receiving the stack 10. The transfer of the sheets from the sheet-guiding cylinder 1.1 by the gripper systems 2.5 and the transfer to the sheet brake 7 are each effected with suitable activation of the gripper systems 2.5 by non-illustrated control cams.

The binding of the sheet guide drum 3 into the chain delivery system 2 described thus far is merely one example for the areas in which the sheet guide drum 3 can be used. Another area of use is in a machine configuration in which printed sheets are transported from a preceding printing unit to a following printing unit by chain conveyors, which are similar to that of the chain delivery system described. In that case, the sheet guide drum 3 would be bound into the chain conveyors analogously to the way described above.

Figure 2:
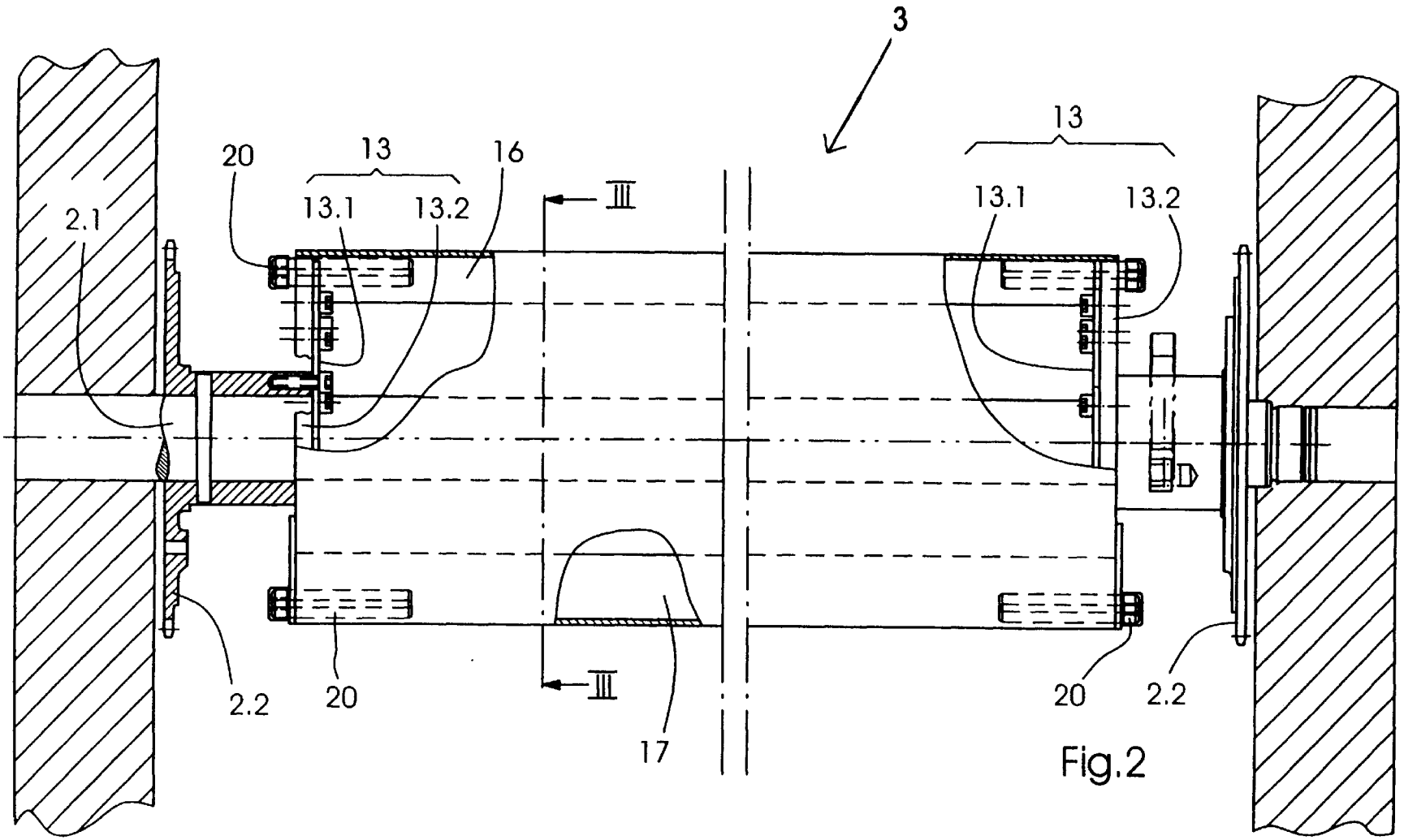
FIG. 2 is a partially, broken away, sectional view of the sheet guide drum of FIG. 1.

FIG. 1 shows an exemplary embodiment of the sheet guide drum 3 in a setup state in which it offers a real jacket face for supporting the sheets 5, specifically in a section shown in detail in FIG. 2.

Regardless of the setup state of the sheet guide drum 3, the drum 3 has segments 13 on its face end, as can be seen in FIG. 2. For reasons that will become clear later in the course of this explanation, a given segment 13 is preferably formed of one support segment 13.1 and one supplementary segment 13.2. The operational rotation of the sheet guide drum 3 that is done jointly with the chain wheels 2.2 with respect to the geometric axis of the chain wheel shaft 2.1 is realized, in the example of FIG. 2, by joining a given support segment 13.1 to a given chain wheel 2.2. The chain wheel 2.2 in turn is connected to the chain wheel shaft 2.1 in a manner fixed against relative rotation, and that the chain wheel shaft 2.1 is connected to a non-illustrated drive.

On the given support segment 13.1, connected to the applicable chain wheel 2.2, the respective supplementary segment 13.2 is disposed on a side of the support segment 13.1 toward the chain wheel 2.2 and is joined to the respective support segment 13.1 by a screw connection. The supplementary segments 13.2, in the exemplary embodiment shown in the drawing, having an outer contour in the form of part of a circle, which is adapted in its length to a maximum size of sheets 5 to be handled and which changes over in a respective end portion of an outer contour into an inlet radius and an outlet radius. The support segments 13.1 also have a length in the circumferential direction that is adapted to the size, but preferably have a shorter length radially than the supplementary segments 13.2. To furnish the real jacket face, the supplementary segments 13.2 have a flexible drum jacket 14 wrapped around it and are separably connected to it.

Figure 3:
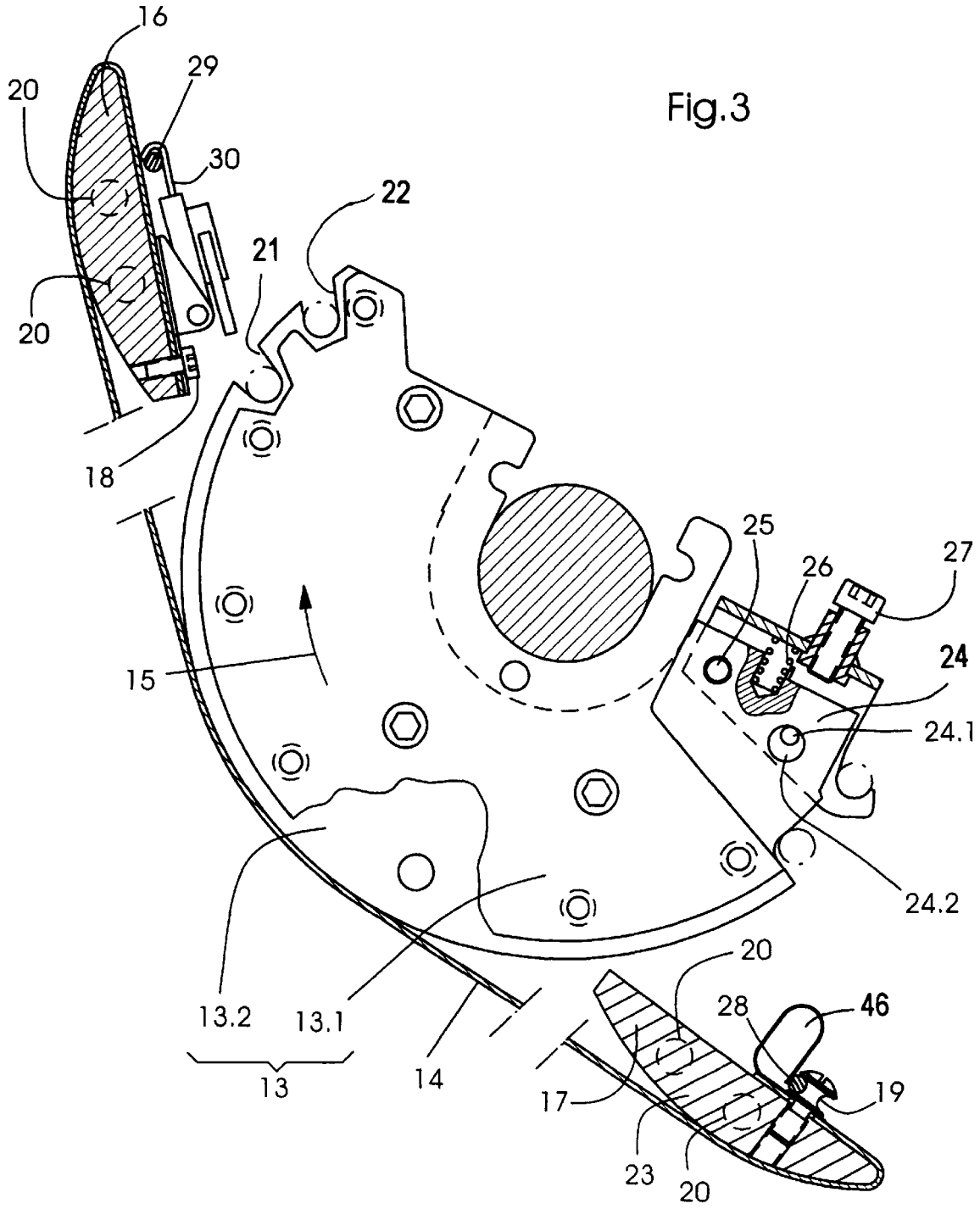
FIG. 3 is a sectional view taken along the line III—III shown in FIG. 2, in a position of the sheet guide drum corresponding approximately to FIG. 1, with a drum jacket shown partly in a developed view leaving out fastening elements for the segment.

One exemplary embodiment of this can be seen from FIG. 3, in which an as yet incomplete state is shown for the sake of clarity. A leading end piece and a trailing end piece of the drum jacket 14, in each case in terms of the direction of revolution of the sheet guide drum 3, indicated by the directional arrow 15, is curved around a respective crossbar 16 and 17. The drum jacket 14 is joined to the crossbars 16, 17, specifically by screws 18 or special screws 19, which will be described in further detail hereinafter. The crossbars 16 and 17 have a cross-sectional contour which in one portion thereof has the same course as the outer contour of the supplementary segments 13.2, and they extend parallel to the chain wheel shaft 2.1 from one of the support segments 13.1 to the other. Pins 20 that protrude past the corresponding cross-sectional faces are inserted each into a respective face-end cross-sectional face of the crossbars 16 and 17. The pins 20 are let into recesses 21, 22, 23 of the supplementary segments 13.2, provided on the circumference of a respective supplementary segment 13.2, in such a way that the aforementioned portion of the cross-sectional contour of the crossbars 16 and 17 whose course is adapted to the outer contour of the supplementary segments 13.2 coincides with the outer contour of the supplementary segments 13.2.

The drum jacket 14, preferably made from a spring steel sheet, extends past the face-end cross-sectional faces of the crossbars 16 and 17 in such a way that it presses against the outer contour of the supplementary segments 13.2 when the portions of the pins 20 that protrude past the face-end cross-sectional faces of the crossbars 16 and 17 are inserted into the recesses 21, 22 and 23. The recesses 21 and 22 intended for retaining the crossbar 16 which is connected to the leading end portion of the drum jacket 14 are embodied in such a way and preferably inclined in such a way that the pins 20 lock into the recesses when a pull is exerted on the drum jacket 14 counter to the arrow 15 shown in FIG. 3. A corresponding pull occurs especially if, once the pins 20 have been inserted into the crossbar 16, the drum jacket 14 is pressed against the outer contour of the supplementary segments 13.2, and a fixation of its trailing end to the supplementary segments 13.2 takes place. When the trailing end of the drum jacket 14, which is fixed by its leading end on the supplementary segments 13.2, presses against the outer contour of the supplementary segments 13.2, the pin 20 that is initially leading, in terms of the direction of rotation indicated by the arrow 15, of the pins 20 inserted into a given face end of the crossbar 17 is braced on the bottom of the recess 23, while the trailing pin of the pins 20 is then engaged from behind by a hook 24. To that end, by a joint 25, the hook 24 is pivotably connected to the supplementary segment 13.2 in and counter to the direction of rotation indicated by the arrow 15 and is braced by a spring 26 on the supplementary segment 13.2 in such a way that the spring 26 opposes a restoring force to a pivoting of the hook 24 in the direction of rotation indicated by the arrow 15 that is required for engagement of the aforementioned trailing pin 20 from behind. The hook 24 is preferably a molded part of U-shaped cross section, and the legs of the U are connected on the one hand to the supplementary segment 13.2 via the joint 25 and on the other have a hook-shaped contour, by which the pin 20 engaged from behind is caught. A stop pin 24.1 is inserted into the legs of the U and fits through a bore 24.2 provided in the supplementary segment 13.2, the diameter of the supplementary segment 13.2 being selected such that the intended pivotability of the hook 24 relative to the joint 25 is assured.

The pin 20 caught by the hook 24 and the pin 20 that has already dipped into the recess 23 assume their intended positions, under the influence of the restoring force of the spring 26. In these positions, the portion of the cross-sectional contour of the crossbar 17 whose course is adapted to the outer contour of the supplementary segments 13.2, coincides with the outer contour of the supplementary segments 13.2. To assure these intended positions, a support screw 27 is inserted into the sheet support of the U-shaped hook 24 and can be braced against the supplementary segment 13.2 in such a way as to block a pivoting motion of the hook 24 in the rotational direction indicated by the arrow 15.

In the setup state described thus far, the face-end segments thus have the flexible drum jacket 14 wrapped around them and are separably connected to it. The real jacket face thus furnished offers the basis for full-surface support of each sheet 5 accepted from the sheet-guiding cylinder 1.1 by the gripper systems 2.5.

As illustrated in FIG. 1, the freshly printed side of the respective sheet 5 faces toward the aforementioned jacket face and provisions are also made to prevent smearing of the freshly printed sheets 5 during guidance by the sheet guide drum 3. To that end, the drum jacket 14 is preferably covered with a covering in the form of a cloth, which has an especially smooth surface on its side remote from the drum jacket 14 and is lined with an ink-repellent net. To a certain extent, any relative motions of the printed sheet 5 placed against the net that occur relative to the drum jacket 14 are followed by the net with a sliding motion of the net relative to the cloth. The net is joined to the cloth by VELCEO closures, for instance, in the face-end regions of the sheet guide drum 3.

The special screws 19 already mentioned above but not described in detail, by which the trailing end point of the drum jacket 14, curved around the crossbar 17, is connected to the trailing crossbar 17, are used to suspend the trailing end of the cloth in terms of the rotational direction indicated by the arrow. On this end, the cloth is provided with loops through which a tension rod 28 is passed. The special screws 19, only one of which can be seen in a row of special screws along the crossbar 17 because of the sectional view selected for FIG. 3, each have a screw head with a groove extending all the way around. The tension rod 28 engages a given one of the grooves and thus fixes the trailing end of the cloth, as the cloth is wrapped around the drum jacket 14, in order to fix the leading end of the cloth. On this end, a tension rod 29 is provided in an analogous way to that on the trailing end of the cloth, and the rod 29 is engaged from behind by toggle-type fasteners 30 that are secured to the crossbar 16, so that the cloth suspended from the special screws 19, wrapped around the crossbar 17 and placed against the drum jacket 14 and finally wrapped around the crossbar 16, is tensed with the closure of the toggle-type fasteners 30. To make assembly easier, spring brackets 46 are secured to the crossbar 17 by the special screw 19 and keep the tension rod 28 in contact with the heads of the special screws 19. Like the special screws 19, the toggle-type fasteners 30 also form a row of toggle-type fasteners along the crossbar 16. The cloth and the net are not shown in the drawing, for the sake of simplicity. It is understood that there are manifold alternatives, of which a few will be briefly described below, for the exemplary embodiment described thus far of the sheet guide drum 3 in the setup state for full-surface support of the sheets 5.

Figure 4:
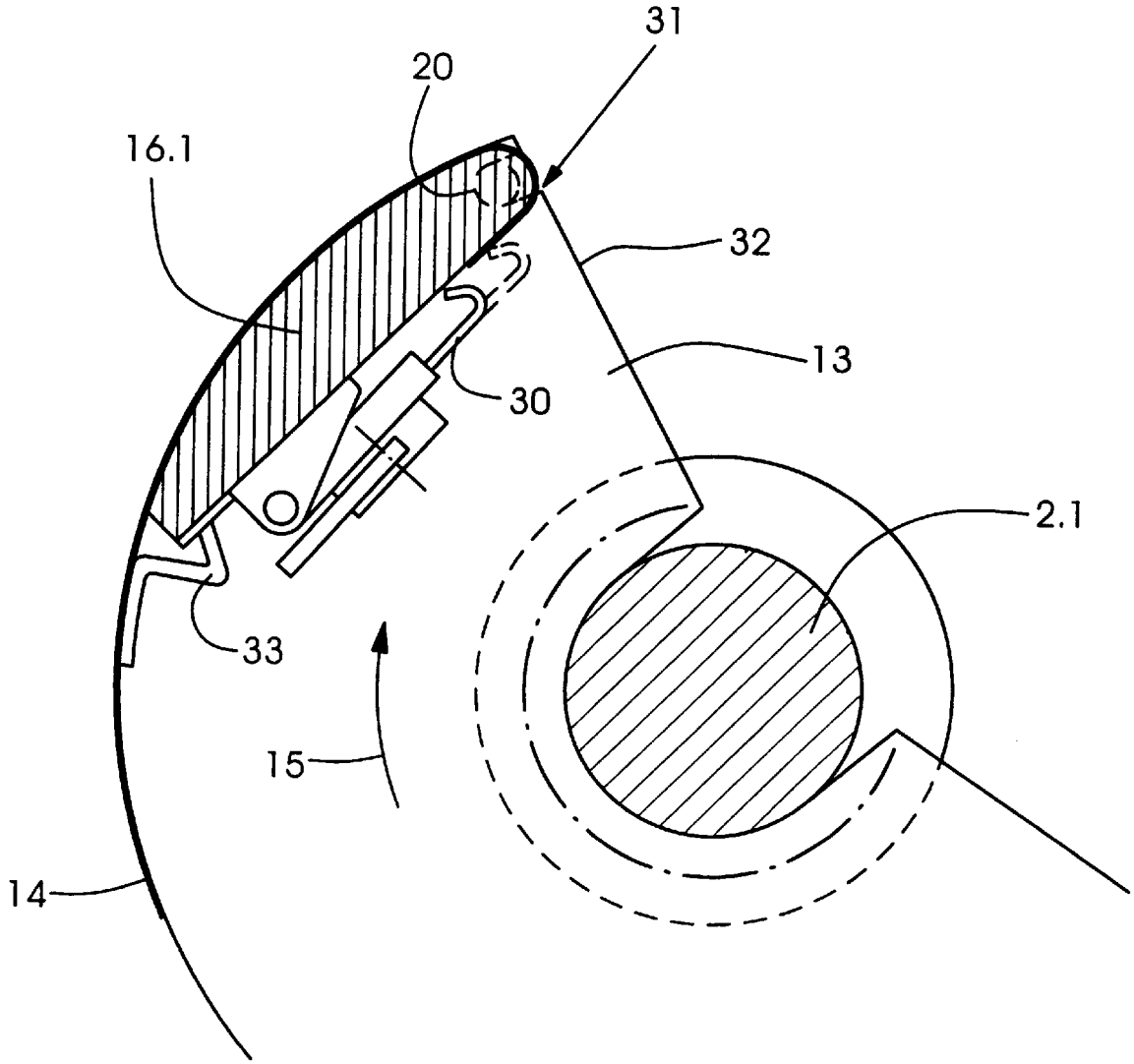

In the example of FIG. 4, a crossbar 16.1 corresponding to the crossbar 16 of FIG. 3 also extends between the two segments 13 of the sheet guide drum 3. However, only one pin 20 protruding past the respective cross-sectional face is inserted into the face-end cross-sectional faces of the crossbar 16.1, specifically in a region of the cross-sectional face that is leading relative to the direction of rotation indicated by the arrow 15. The protruding portion of the pin 20 is suspended in a recess 31 in a leading face end 32, in terms of the direction of rotation indicated by the arrow 15, of the respective segment 13. On a trailing end in terms of the direction of rotation indicated by the arrow 15, the crossbar 16.1 is held by a resilient clamp 33, which is fixed to the inside of the drum jacket 14 and which prevents the crossbar 16.1, under the influence of a tensing force generated by the toggle-type fasteners 30 for tensing the cloth as already explained, from tipping around the pins 20 in the direction toward the chain wheel shaft 2.1.

In the example of FIG. 5, a crossbar 16.2 is provided, again corresponding to the crossbar 16 of FIG. 3, and it is separably connected to the two segments 13 of the sheet guide drum 3. To that end, one pin 20', provided with a collar 20", visible in FIG. 5*a* is inserted longitudinally displaceably in a leading region, in terms of the rotational direction indicated by the arrow 15, of the respective face-end cross-sectional face of the crossbar 16.2. Between a first face end of a given collar 20" and the respective face-end cross-sectional face of the crossbar 16.2, there is a respective compression spring 20'", counter to whose restoring force the respective pin 20 can be inserted into a respective bore 16.2' made in the face-end cross-sectional face of the crossbar 16.2, so that a portion of that pin 20' adjoining the respective second face end of a given collar 20" snaps into place in a bore 34 made in a given segment 13, under the influence of the restoring force of the respective compression spring 20'".

To prevent the crossbar 16.2 from tipping about the aligned pins 20' in response to a moment that acts along their longitudinal axis and is generated by the tensing of the cloth by the toggle-type fasteners 30, the crossbar 16.2 is joined to the drum jacket 14. In the case of FIG. 5, a row of threaded bolts 35 disposed along the crossbar 16.2 is welded for this purpose to the inside of the drum jacket 14. Each bolt 35 extends through a respective recess 36 in the crossbar 16.2 and, via a nut 37 screwed onto the respective threaded bolt 35, supports the crossbar 16.2 on the drum jacket 14 so that it cannot tilt around the pins 20'. The recesses 36 are dimensioned such that the crossbar 16.2, after being slipped onto the welded bolts 35, can be displaced relative to the drum jacket 14 into the position in which the bent-over end portion of the drum jacket 14 grips the crossbar 16.2.

Instead of a screw connection between the drum jacket 14 and the crossbar 16.2, in further exemplary embodiments the crossbar is adhesively joined or soldered or preferably welded with a rolling seam to the drum jacket 14 in the aforementioned position.

Figure 6:
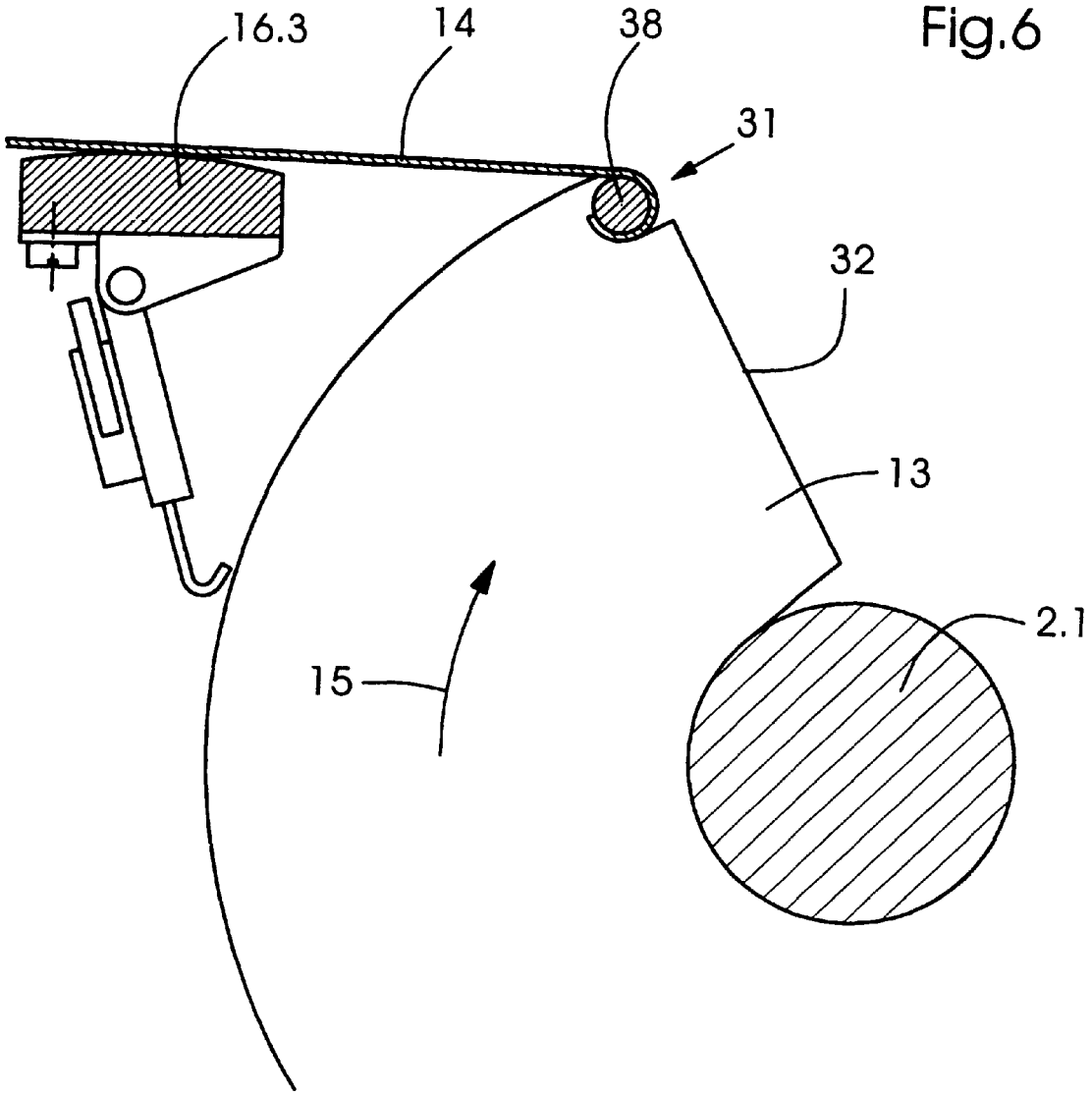

In the exemplary embodiment shown in FIG. 6, in an incomplete assembly state of the sheet guide drum 3, a leading end portion of the drum jacket 14, in terms of the direction of rotation indicated by the arrow 15, is wound around a round bar 38, which on a given end, analogously to the pins 20 of FIG. 4, is suspended each in a respective recess 31 in a leading end face 32, in terms of the direction of rotation indicated by the arrow 15, of a given one of the segments 13.

A crossbar 16.3, serving on the one hand to further stabilize the drum jacket 14 longitudinally of the chain wheel shaft 2.1 and on the other to receive the toggle-type fasteners 30. The crossbar is disposed parallel to the round bar 38 and being disposed between the segments 13, is connected to the drum jacket 14, on its inside, in the manner already described. The contour of the cross section of the crossbar 16.3 oriented toward the drum jacket 14 has the same radius as the circular-segmental outer contour of the segments 13 of the previous example.

Figure 7:
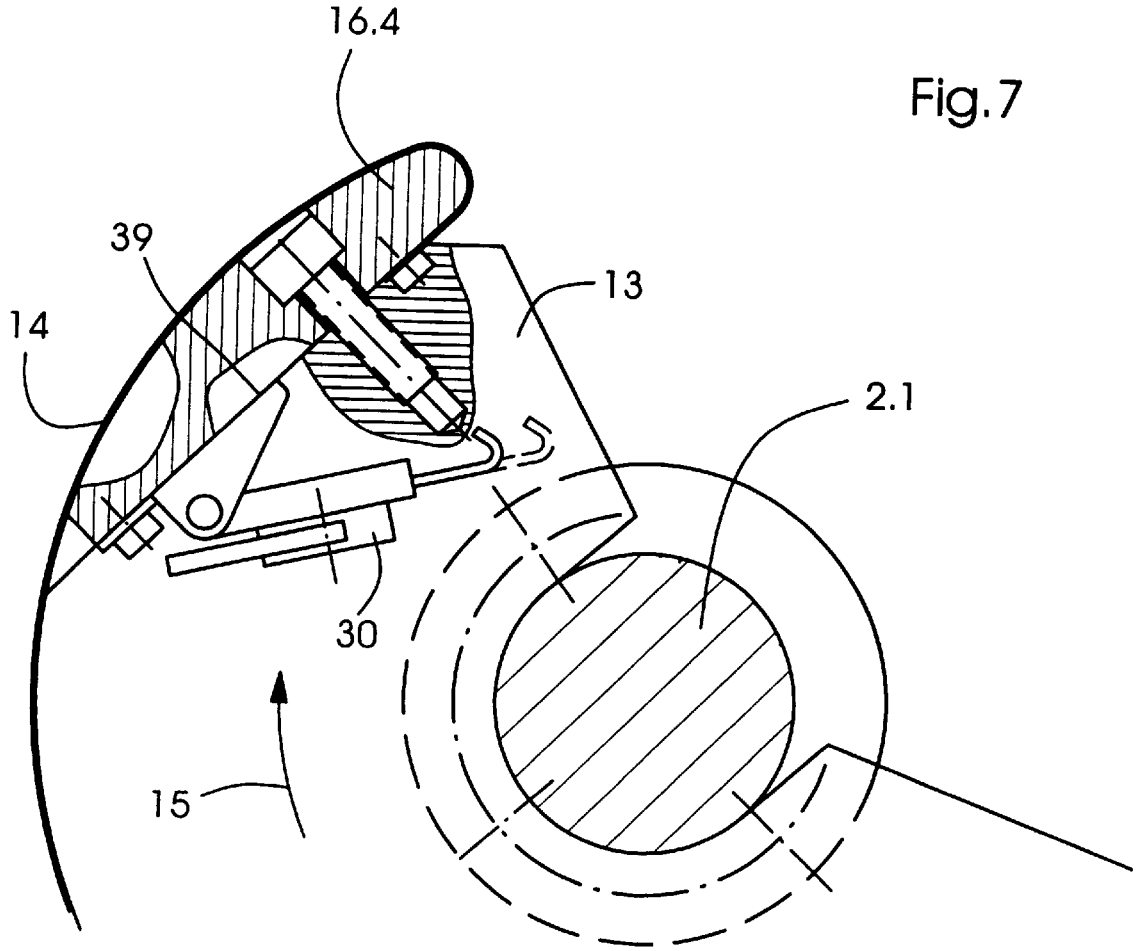

The exemplary embodiment shown in FIG. 7 again uses a crossbar 16.4 that in terms of the cross section and its disposition relatively to the drum jacket 14 is analogous to the crossbars 16, 16.1, 16.2. However, the crossbar 16.4 does not extend between the segments 13. Instead, it is placed on a flat face 39 of the segment 13 and screwed to it in such a way that the circular-segmental cross-sectional contour already described for the crossbar 16.4 and the outer contour of the respective segment 13 adjoining the flat face 39 have one and the same radius and have a common envelope circle with that radius.

Along with the exemplary embodiments for the separable connection of the segments 13 to the drum jacket 14 by its leading end in terms of the direction of rotation indicated by the arrow 15, described thus far, it is understood that there are also alternatives for an embodiment on the trailing end of the drum jacket 14, a few of which will now be described in conjunction with FIGS. 8–11. Each of the FIGS. 8–11 shows a trailing end of the drum jacket 14 in an incomplete state of the sheet guide drum 3 and correspond in terms of the section shown to that of FIG. 2.

In particular, one common feature of the exemplary embodiments is that the trailing end of the drum jacket 14 is wound around a round bar 38 in a way similar to its leading end in FIG. 6, and in this way a separable connection of the drum jacket 14 with the segments 13 can be made. To that end, the outer contour of the given segment 13 is provided, in a portion of the outer contour that is trailing in terms of the direction of rotation indicated by the arrow 15, with a recess, which corresponds to the recess 23 of FIG. 3 in the sense that the round bar 38, with the drum jacket 14 placed on it, is braced on the bottom of this recess in such a way that it can be preferably engaged from behind by a device corresponding to the hook 24 and placed accordingly and can be tensed in the circumferential direction of the segments 13. It will be understood that for this purpose, as in the exemplary embodiments described above, the drum jacket 14 has correspondingly notched corners, because after all it is given its form by wrapping around the segments 13 and pressing against their outer contour.

It is also common to the exemplary embodiments of FIGS. 8–11 that the drum jacket 14 is connected on its inside to a respective crossbar 17.1 or 17.2 which as in the example of FIG. 6 is not involved in the separable connection of the drum jacket 14 to the segments 13. The crossbar on the one hand contributes, in addition to the round bar 38, to stabilizing the drum jacket 14 in the direction of its jacket lines in the as yet unmounted state thereof, and on the other carries the special screws 19, already described in conjunction with FIG. 3, for suspending the already-described tension rod 28 for the cloth explained in this connection. The crossbars 17.1 and 17.2 also extend between the two face-end segments 13 of the sheet guide drum 3.

Furthermore, the contour of the cross sections of the crossbars 17.1 and 17.2 that faces the drum jacket 14 has the same course as the outer contour of the segments 13.

The exemplary embodiments of FIGS. 8–11 differ in how the crossbars 17.1 and 17.2 are secured to the drum jacket 14.

Figure 8:
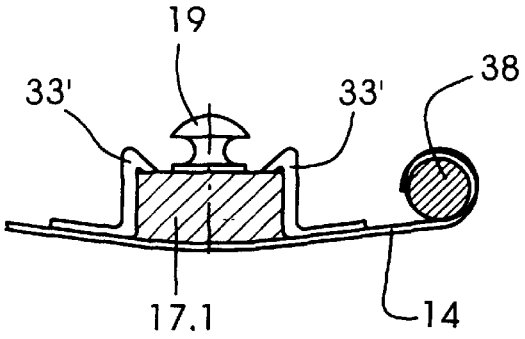
FIGS. 8–11 are sectional view of embodiments for connecting a trailing end region of the drum jacket to a crossbar that stabilizes the drum jacket, with retainers for a cover fastened around the drum jacket.

In the case of FIG. 8, resilient clamps 33' facing one another are fixed to the inside of the drum jacket 14. The clamps being similar to those used in the exemplary embodiment of FIG. 4, so that the crossbar 17.1, by placement of the drum jacket 14 against the contour facing it of the cross section of the crossbar 17.1, can be snapped in place between the clamps 33' as shown in FIG. 8.

Figure 9:
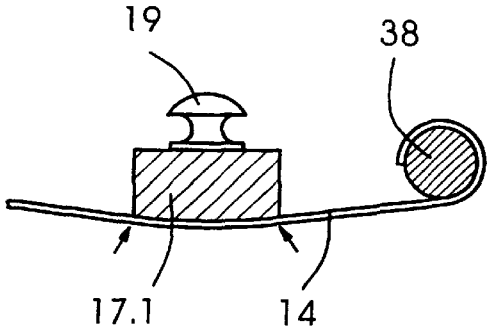

In the case of FIG. 9, the crossbar 17.1 is joined, on the side of its cross-sectional profile that has the same course as the outer contour of the segments 13, to the inside of the drum jacket 14 by adhesive bonding or soldering or by spot or rolling seam welding along jacket lines of the drum jacket 14 in regions thereof toward which the arrows in FIG. 9 point.

Figure 10:
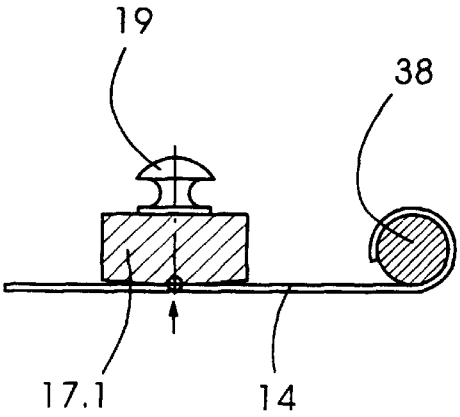

In the case of FIG. 10, corresponding welding is provided only in one region, again indicated by an arrow, along a jacket line of the drum jacket 14.

Figure 11:
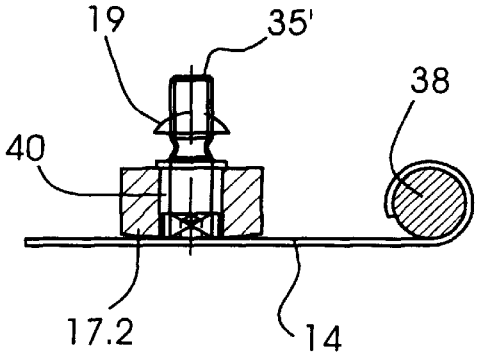

In the case of FIG. 11, threaded bolts 35' are welded in a row parallel to the round bar 38 to the inside of the drum jacket 14. The crossbar 17.2 has recesses 40 which correspond to the threaded bolts 35' and through which, for connection of the drum jacket 14 to the crossbar 17.2, the threaded bolts 35' extend, so that a screw connection analogous to the example of FIG. 5 can be made.

The segments 13, each composed of a given support segment 13.1 and a given supplementary segment 13.2, can also be made in one piece with a view to the functions they are intended to perform. If the sheet guide drum 3 is to be used exclusively in a setup state in which skeleton-like sheet supports are provided, for instance for the case where the printing press equipped with the retrofittable sheet guide drum 3 is initially provided only for special, identical kinds of printing jobs, the preferably provided subdivision of the segments 13 each into one support segment 13.1 and one supplementary segment 13.2 does prove to be advantageous in the sense that an economical basic model of the printing press can be provided initially. If it is later retrofitted for printing jobs in which it proves expedient for the sheet guide drum 3 to be suitable for supporting the sheets 5 over more of their surface, then the supplementary segments 13.2 would be components of a corresponding retrofitting kit.

A further advantage of subdividing the segments 13 into one support segment 13.1 and one supplementary segment 13.2 that carries the drum jacket is that in this case a set of supplementary segments 13.2 of a certain geometry of their outer contour can also be replaced by another set of supplementary segments 13.2 whose outer contour is different. Optionally in such a replacement, the drum jacket is also replaced by a drum jacket having a different circumferential length. Overall, the geometry of the sheet guide drum 3 in its second setup state can thus be varied in terms of the radial length and the course of the drum jacket in the circumferential direction. Optionally, this course can also deviate from a constant curvature, between inlet and outlet radii mentioned above that can be selected in turn.

Figure 12:
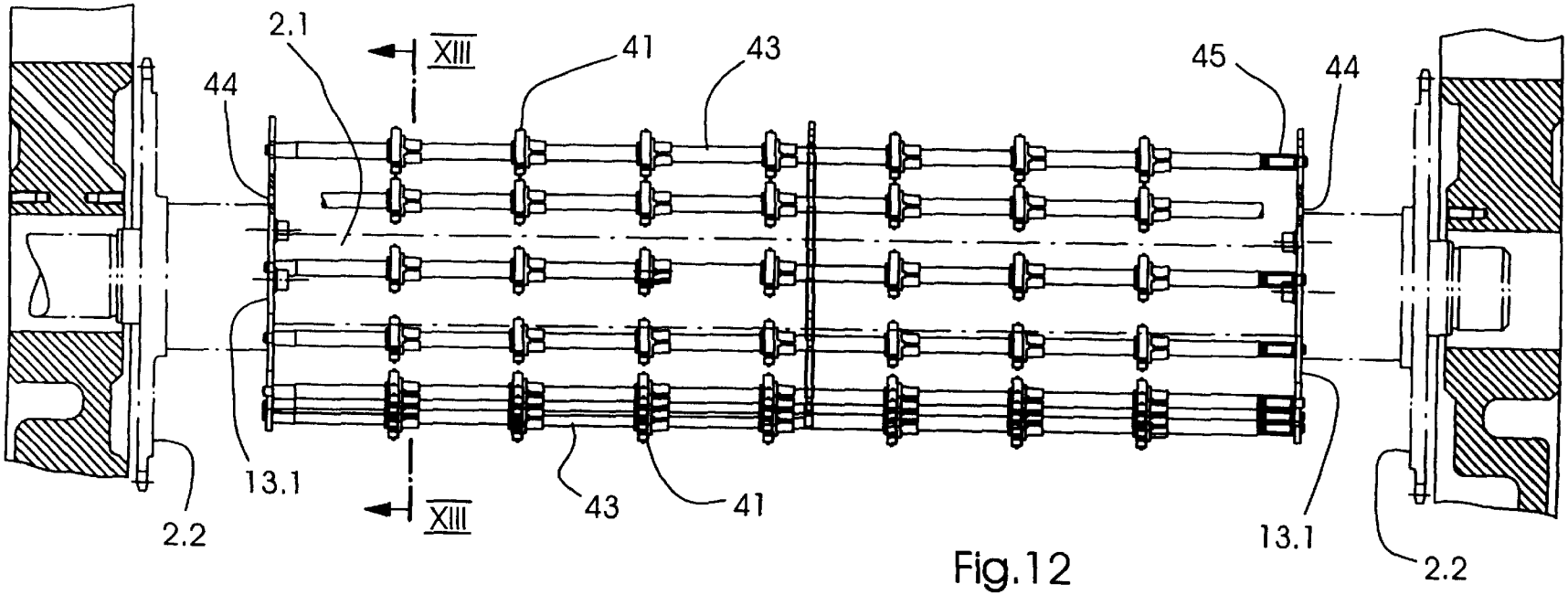
FIG. 12 is a side-elevational view of the sheet guide drum in a setup state of the drum in which skeleton-like sheet supports are provided.

The setup state of the sheet guide drum 3 in which the drum 3 furnishes sheet supports formed of a skeleton frame instead of the drum jacket 14 is shown in FIG. 12 for the case of segments 13 subdivided into support segments and supplementary segments. For receiving the skeleton-like sheet supports, only the support segments 13.1 are needed, so that in this setup state of FIG. 12 the sheet-guide drum 3 also has only the support segments 13.1.

Figure 12A:
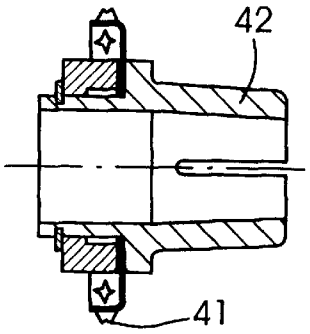
FIG. 12*a* is a sectional view of an exemplary embodiment for sheet supports having a skeleton frame in the form of a rowel.
Figure 13:
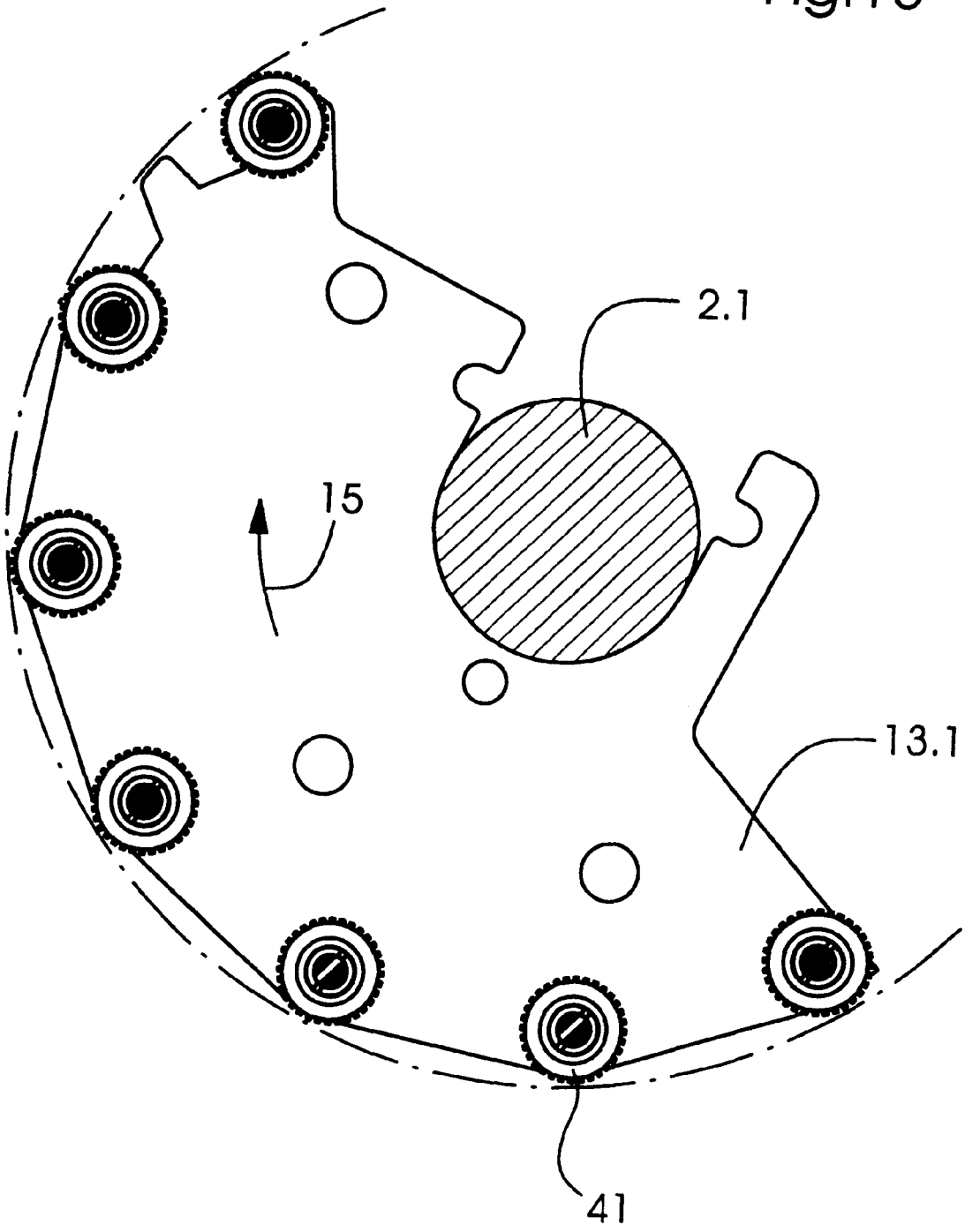
FIG. 13 is a section view taken along the line XIII—XIII shown in FIG. 12, leaving out fastening elements for the segment.

In the present example, skeleton-like sheet supports 41 are provided in the form of rowels or wheels with spurs or a grooved surface, shown in section in FIG. 12*a*. A given rowel is supported easily rotatably on a hub 42. The hub 42 has a bore, which is adjoined by an internal cone and is longitudinally slit in the region of the internal cone. The hub 42 can be slipped onto a rod 43 by widening of the internal cone. As can be seen FIG. 12, a plurality of rods 43 each have a plurality of rowels 41 per rod 43. The rods 43 are received separably, on a given end thereof, in a respective one of the support segments 13.1. To that end, a respective one of the support segments 13.1 is provided with bores 44, which are located on a pitch circle concentric with the chain wheel shaft 2.1. A given rod 43 is provided, on both of its ends, with an extension adapted to the diameter of the bores 44, and one of these extensions is embodied to receive a helical spring 45. A given rod 43 can be inserted by the extension carrying the helical spring 45, counter to its restoring force, into a respective bore 44 in one of the support segments 13.1 and has a length such that with axial tension by the helical spring 45, it can be snapped by the extension on the other end of the rod 43 into a corresponding bore of the other support segment 13.1. The rods 43 received in corresponding bores 44 of the two support segments 13.1 are oriented parallel to the chain wheel shaft 2.1. Thus the skeleton-like sheet supports 41 are disposed overall in such a way that a cylindrical envelope face concentric to the chain wheel shaft 2.1 is tangent to them. In FIG. 13 the envelope face, shown here in section, is represented by a dot-dashed line. It represents the geometric location for contact points, distributed in point form, of the given sheet 5 with the sheet guide drum 3 in its setup state in which it is provided with skeleton-like sheet supports 41.

I claim:

1. A sheet-fed printing press, comprising:

at least one retrofittable sheet guide drum having an end face and segments disposed on said face end; and skeleton-shaped sheet supports separably connected to said segments in a first setup state; and a flexible drum jacket separably connected to said segments in a second setup state in place of said skeleton-shaped sheet supports.

2. The sheet-fed printing press according to claim 1, wherein said skeleton-shaped sheet supports are rowels.

3. A sheet-fed printing press, comprising:

at least one retrofittable sheet guide drum having an end face and segments disposed on said face end; and a sheet guiding device selected from the group consisting of skeleton-shaped sheet supports and a flexible drum jacket separably connected to said segments.

4. The sheet-fed printing press according to claim 3, wherein said skeleton-shaped sheet supports are rowels.

5. The sheet-fed printing press according to claim 3, wherein said segments each include a support segment and a supplementary segment attached to said support segment.

* * * * *